United States Patent [19]

Hillstrom et al.

[11] 4,273,612

[45] * Jun. 16, 1981

[54] PROCESS AND APPARATUS FOR CONTINUOUSLY WASHING AQUEOUS FIBROUS SUSPENSIONS AND CONTROLLING THE VOLUME OF WASH LIQUID

[75] Inventors: Per A. R. Hillstrom, Domsjo; Lars G. Norehall, Ornskoldsvik, both of Sweden

[73] Assignee: Mo och Domsjo Aktiebolag, Ornskoldsvik, Sweden

[ * ] Notice: The portion of the term of this patent subsequent to Feb. 6, 1996, has been disclaimed.

[21] Appl. No.: 46,742

[22] Filed: Jun. 8, 1979

Related U.S. Application Data

[63] Continuation of Ser. No. 785,487, Apr. 7, 1977, abandoned.

[30] Foreign Application Priority Data

Apr. 14, 1976 [SE] Sweden ..... 7604430

[51] Int. Cl.[3] ..... D21C 9/02

[52] U.S. Cl. ..... 162/49; 8/156; 162/60; 162/252; 162/263; 162/DIG. 10

[58] Field of Search ..... 162/49, 60, 252, 253, 162/263, DIG. 10; 23/230A; 364/471; 68/181 R; 8/156, 158; 73/61 R; 137/5, 6, 88

[56] References Cited

U.S. PATENT DOCUMENTS

| | | | |
|---|---|---|---|
| 2,745,712 | 5/1956 | Burling et al. | 162/60 X |
| 3,802,964 | 4/1974 | Furgacs et al. | 162/263 |
| 4,138,313 | 2/1979 | Hillstrom et al. | 162/60 |

FOREIGN PATENT DOCUMENTS

| | | | |
|---|---|---|---|
| 993541 | 7/1976 | Canada | 162/DIG. 10 |
| 2163039 | 7/1973 | France | 162/DIG. 10 |

*Primary Examiner*—S. Leon Bashore
*Assistant Examiner*—Steve Alvo

[57] ABSTRACT

A process is provided for continuously washing fibrous suspensions in aqueous suspending liquors containing dissolved impurities to remove such impurities by exchanging aqueous suspending liquid substantially free from such impurities for the aqueous suspending liquor, which comprises washing fibrous material of the suspension in aqueous suspending liquid substantially free from dissolved impurities; and forming a washed fibrous suspension in such liquid; withdrawing aqueous suspending liquor containing dissolved impurities; diluting the washed fibrous suspension by adding aqueous suspending liquid substantially free from dissolved impurities; measuring the volume amount of such diluting aqueous suspending liquid added; measuring the volume amount of diluted washed fibrous suspension; and then adjusting the volume amount of wash liquid added to maintain substantially constant the difference between the amount of wash liquid added and the liquid content of the undiluted washed fibrous suspension.

9 Claims, 2 Drawing Figures

Figure 1:
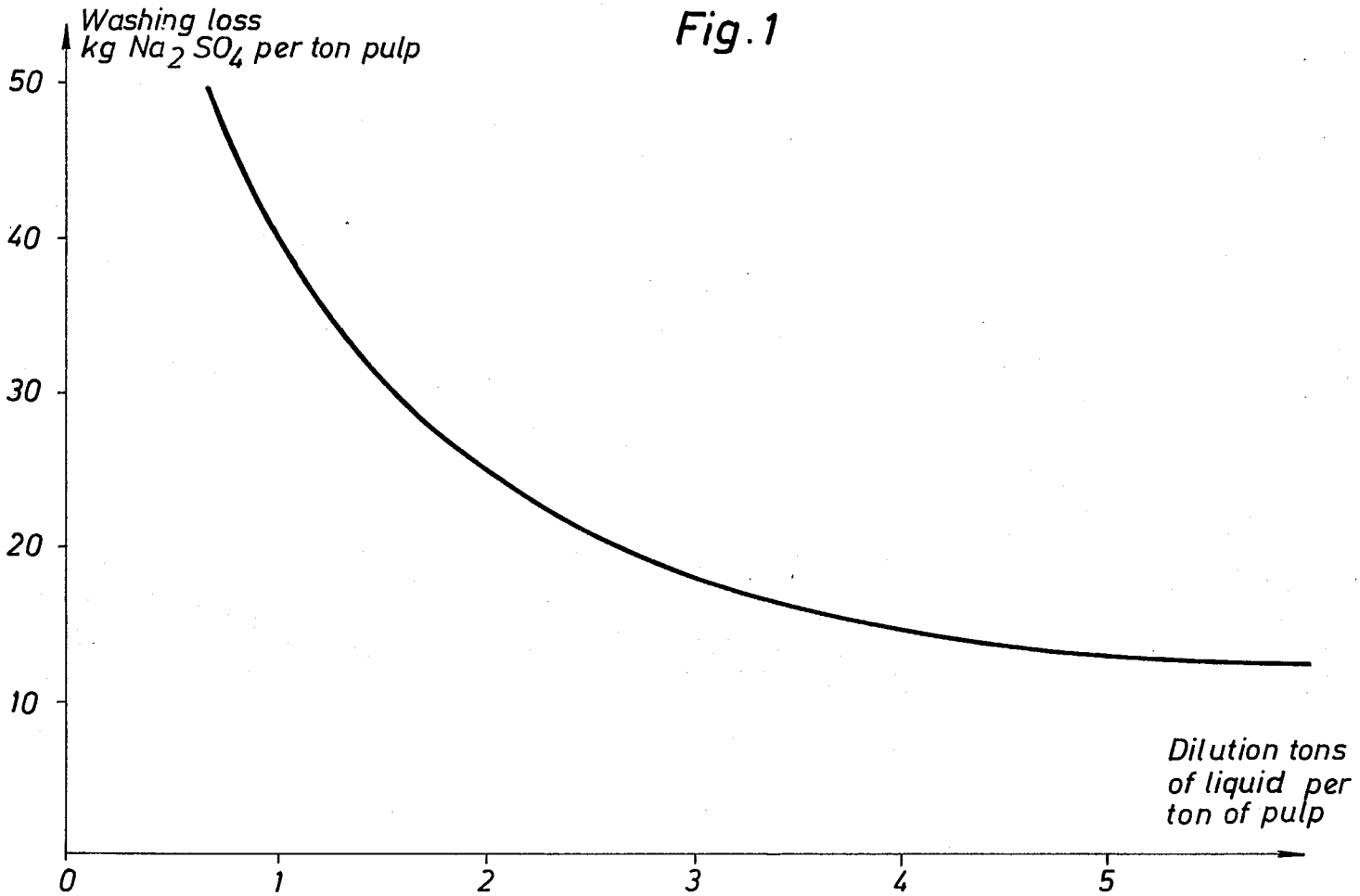

PROCESS AND APPARATUS FOR CONTINUOUSLY WASHING AQUEOUS FIBROUS SUSPENSIONS AND CONTROLLING THE VOLUME OF WASH LIQUID

This is a continuation of application Ser. No. 785,487 filed Apr. 7, 1977, now abandoned.

Cellulose pulp is normally washed after separation of the pulping liquor at the conclusion of the digestion, before it is passed on to subsequent chemical treatment stages, such as bleaching. The pulping liquor contains substantial quantities of impurities, and if these impurities are not removed from the cellulose fibers, or the concentration thereof at least greatly reduced, the subsequent chemical treatments applied to the pulp fibers, particularly bleaching, may be relatively ineffective. The impurities may react with the treating chemicals, and therefore not only reduce their effect, but also require the addition of larger amounts of the treating agents, which are of course wasted. Dissolved impurities present in the pulping liquor after digestion include the pulping chemicals and the water-soluble organic substances which are formed in the course of the pulping process, and become dissolved in the liquor. The dissolved impurities accordingly accompany any aqueous suspending liquor for the cellulose pulp suspension.

The impurities are valuable as a source of fuel, and therefore can be burned, utilizing the heat elsewhere in the pulp mill. Inorganic materials are also burned and recovered as smelts, in the combustion residues, and the smelt can be recycled as a source of pulping chemical values, particularly sulfur and alkali. The dissolved materials present in the pulping liquor and in the suspending liquor for the fibrous cellulose pulp suspension can be collectively referred to as the solids content of the liquor, and the solids content is normally expressed as a percentage equal to the total quantity of solids materials, i.e., organic and inorganic materials present, divided by the total quantity of pulping liquor.

Accordingly, the cellulose pulp washing system is designed to remove the dissolved water-soluble impurities, and this is normally done by simply replacing the aqueous suspending liquor containing dissolved impurities with a fresh or relatively pure suspending liquid, substantially free from such impurities, or at least having a lower content thereof than the aqueous suspension from the pulper or digester.

Cellulose pulp washing systems are highly specialized, and a special terminology has been developed to refer to various aspects thereof. Several of the more important and more commonly encountered terms are defined below:

Original black liquor

The pulping liquor which serves as a suspending medium for the cellulose pulp in the digester at the conclusion of the pulping process. This liquor contains dissolved pulping chemicals, and also inorganic and organic materials produced as by-products in the pulping reactions, including organic water-soluble material dissolved from the wood.

Recovered black liquor or release liquor

The black liquor which is obtained subsequent to washing the pulp after separation of the original black liquor, and containing a part of the dissolved solids present in the original black liquor. The recovered black liquor or release liquor is passed to the evaporation stage. After evaporation, the concentrated liquor is referred to as heavy black liquor or thick black liquor.

Washing losses

The quantity of original black liquor solids materials which remains with the washed cellulose pulp suspension after washing has been completed. These are the dissolved chemicals from the original black liquor. In Kraft pulping, the washing losses are expressed as kilograms of sodium sulfate per ton of pulp. In sulfite pulping, the washing losses are expressed as kilograms of $Na_2O$ or MgO per ton of pulp, depending upon whether sodium or magnesium base pulping liquor is used. In sulfite pulping, the washing losses can also be expressed as the total loss of solids, including both inorganic and organic materials. The washing losses can also be expressed in terms of $BOD_7$ or COD-loss. $BOD_7$ (measured in accordance with the standard analytical method SCAN-W 5:71) is an abbreviation for biochemical oxygen demand, i.e., the consumption of biochemical oxygen. The analytical procedure referred to determines how much oxygen as $O_2$ the washing losses i.e., the organic portion thereof, consumes after discharge in the atmosphere and storage for 7 days at a temperature of 20° C., and measured biochemically. COD is an abbreviation for chemical oxygen demand, and refers to the amount of chemical oxygen consumed. This determines how much oxygen as $O_2$ the washing losses, i.e. the organic portion and a portion of the inorganic materials, consumes when discharged to the atmosphere and measured chemically.

It is apparent that the washing loss varies according to the pulping process, and the analytical technique used to determine it. The washing loss determination, however made, is a direct measurement of the efficiency of the washing system.

Dilution Factor (DF)

The difference between recovered black liquor and original black liquor, i.e. the quantity of black liquor in excess of the quantity of original black liquor charged to obtain the desired washing. Dilution factor is often expressed in terms of ton or cubic meter of liquid per ton of pulp.

The term "dilution factor" can only be used in a closed washing system or sub system with four flows only as shown below:

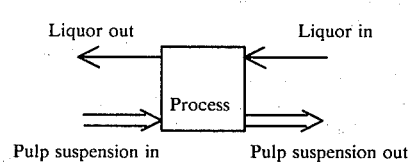

e.g. a process with:

one pulp suspension stream in,
one pulp suspension stream out,
one liquor stream in,
one liquor stream out.

The definition of dilution factor (DF) applied to this scheme gives:

DF = Liquor out—Liquor in pulp suspension in per unit of pulp. When making a liquor balance over the system it can also be shown that:

DF = Liquor in—Liquor in pulp suspension out per unit of pulp.

Figure 2:
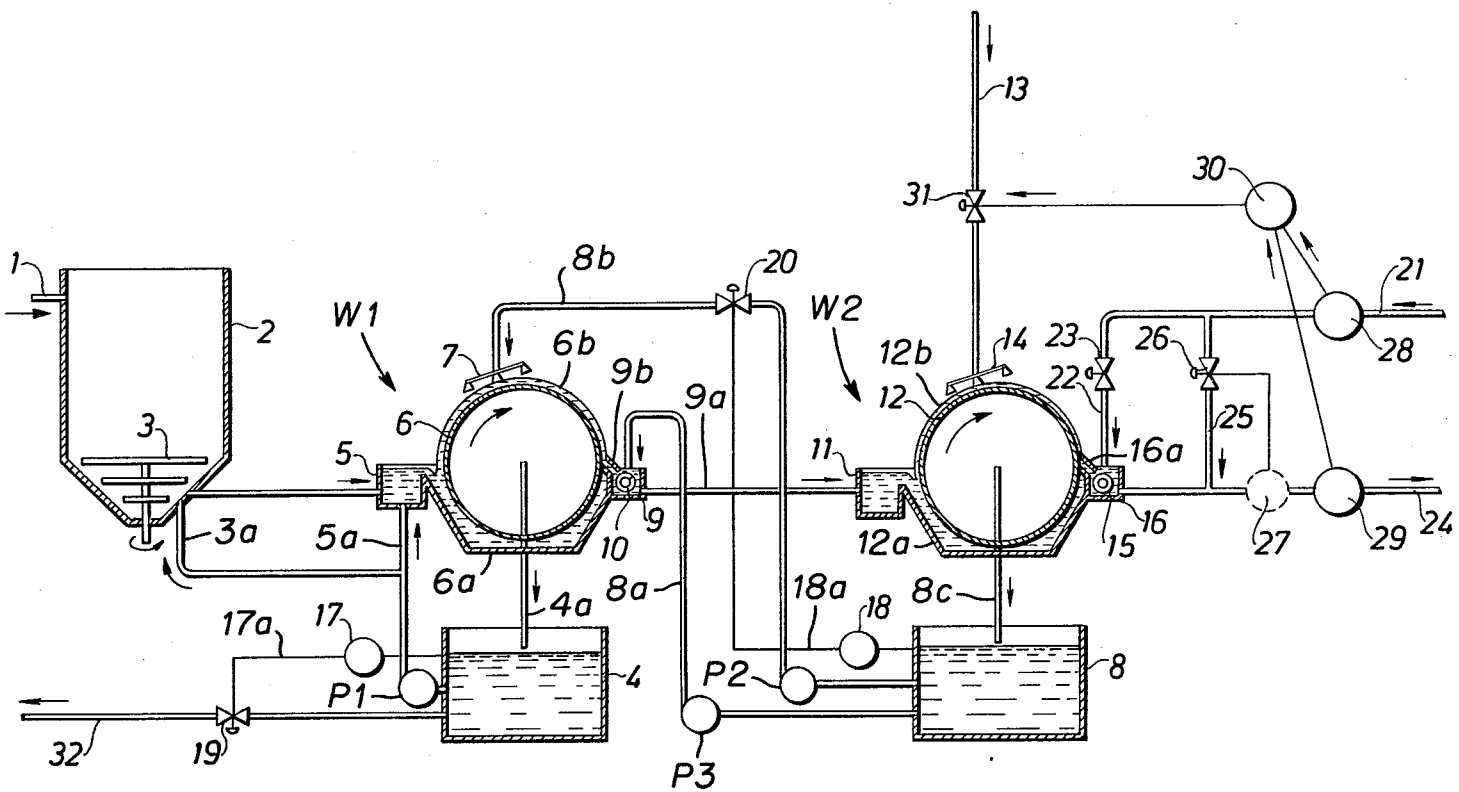

The washing system described in FIG. 2 corresponds to this scheme. The corresponding numbers in FIG. 2 are:

1 = pulp suspension in
at 16a = pulp suspension out
13 = liquor in
32 = liquor out.

It should be noted that the washing system ends at the doctor blade 16 and that no liquor from the line 21 enters the washing system but is used only to make it possible to determine the amount of liquor in the pulp that leaves the washing system at 16a.

Fibrous cellulose pulp suspensions are normally washed in one or more washing stages. Usually, three or four washing stages are used. When a multiplicity of washing stages are employed, the stages are arranged in counterflow, i.e., the fresh washing liquor is supplied to the last stage and then progresses forwardly towards the first washing stage, in series along the line of washing stages. In this way, the cellulose pulp suspension containing the greatest proportion of impurities encounters the washing liquor containing the greatest proportion of dissolved impurities removed, so that the washing liquor despite accumulated impurities is used efficiently from stage to stage, and the final washing stage, where the washing liquid used is often pure water, can be expected to remove substantially all of the remaining dissolved impurities. The spent washing liquor from the first washing stage containing the impurities dissolved from the starting cellulose pulp suspension is then collected, and the solids content recovered as desired.

For optimum washing efficiency, it is obviously desirable to carry out the washing with the least possible amount of washing loss and the least possible dilution of the recovered black liquor. The smaller the washing loss, the cleaner the cellulose pulp, and the greater the proportion of pulping chemicals and organic substances recovered. The least possible dilution is desired because recovery of the dissolved chemicals then requires less energy in removal of the liquids.

There is however a relationship between the washing losses and the dilution factor, and this relationship is shown in FIG. 1, which represents a graph of washing loss against dilutin factor of the cellulose pulp. It is apparent from the curve in FIG. 1 that dilution factor must be increased for minimum washing loss. The curve in FIG. 1 is based on values obtained during the washing operations on a plant scale in a Kraft pulp mill. Washing losses are appreciably lower at high dilution factors. A balanced process therefore requires that washing loss and dilution factor be brought into an appropriate relationship, according to the available facilities and other parameters of the pulp mill. Dilution factor, for example, is limited by the capacity of the evaporating plant, which can only accommodate a given quantity of liquid per unit time.

In practice, the washing system does not normally give a pulp whose concentration is constant. On the contrary, the concentration of the pulp varies considerably, over a period of time. This is a result of the construction of the washing system, and the properties of the pulp.

Fibrous cellulose pulp suspensions vary considerably in drainage or dewatering characteristics. Thus, the pulp may be quite resistant to dewatering, or it more readily accept dewatering. It is generally known that the extent to which the pulp is digested has an effect on the dewatering characteristics of the pulp. Thus, even if a constant amount of washing liquid is added to the pulp, the dilution factor of the washing system will vary, although it is proportional to the amount of washing liquid added. The extent to which the pulp is rewetted by the spent washing liquid also varies with the washing system, even though this liquid may have been withdrawn from the pulp previously. As a result, it is quite difficult to control the washing of the pulp so as to obtain a satisfactory removal of dissolved impurities in the aqueous suspending liquor, and at the same time control the dilution factor of the pulp.

In most cellulose pulp washing systems in use today, the amount of washing liquids supplied, and also the extent to which the pulp is diluted, is controlled in either of two different ways.

In one type of washing system, the amount of fresh washing liquid charged to the last washing stage is so controlled that the amount is proportional to the amount of pulp that is withdrawn from the washing system. This means that variations in the dilution factor are proportional to the concentration of the pulp leaving that last washing stage. The dilution factor can be either negative, i.e. the amount of washing liquid supplied to the last washing stage is less than the amount of liquid which accompanies the pulp from the washing system, or have a high positive value, i.e., an insignificant lowering of the washing losses is obtained at the same time as large quantities of liquid are supplied to the system.

In the other type of washing system, the wash liquor supplied is so controlled as to obtain a constant solids content of the recovered black liquor. The solids content is determined by measuring the density of the recovered liquor. The density is normally given in °Bé (degrees Baumé). Since a washing system often requires large storage volumes of washing liquid, there is a lapse of several hours before a change in the solids content of the recovered liquor can be noted, and compensated for by the amount of washing liquid added. This means that the dilution factor in the system cannot be closely controlled, and there will be a considerable time lag, in the course of which the pulp may be excessively diluted or not diluted enough, before the change in solids content in the recovered liquor is noted at the other end of the system.

It has recently been established that the best washing results are obtained when the dilution factor is held constant over a long period of time, as evidenced by FIG. 1. If it be assumed that a specific washing system has a washing loss of 18 kilograms sodium sulfate per ton of dry pulp, with a dilution factor of 3 tons of liquid per ton of pulp, and that over a period of one hour the dilution factor has fallen from three tons to two tons of liquid per ton of pulp, the washing loss over this period will increase from 18 to 25 kilograms sodium sulfate per ton, i.e. an increase of 7 kilograms sodium sulfate per ton of pulp. In order to compensate for this increase in washing losses, it is necessary to increase the dilution factor over a period of one hour from three tons to beyond six tons of liquid per ton of pulp. The washing losses are reduced by $18-12=6$ kilograms sodium sulfate per ton of pulp. This means that the quantity of liquid to be evaporated is more than doubled, which has a very disadvantageous effect on the heat economy.

In other words, when the dilution factor swings between such extremes, the washing losses can be much greater than if dilution factor is maintained constant, at the mean of the two extremes. This is due to the fact that washing losses increase much more with decreased dilution factor than the improvement in washing losses which can be obtained when dilution factor is increased to a given mean value.

In order to control dilution factor, and to hold a constant dilution factor, it is necessary to know the liquid content of the pulp leaving the washing system. At present, there are no ways known for determining the liquid content of the pulp at this stage.

Such a determination encounters a number of difficulties. One reason is that most washing apparatus in common use, such as wash filters, produce a very wide pulp web. The liquid content of the pulp cannot accurately be determined at random points of a wide web, or over a certain portion of the width. Moreover, when using wash filters, the pulp in the web is rewetted as a result of foaming, as the web is removed from the last filter stage.

In accordance with the present invention, it becomes possible to determine continuously the liquid content of the cellulose pulp suspension leaving the washing system, thereby making it possible to control the dilution factor of the washing system. The process in accordance with the invention for continuously washing fibrous suspensions in aqueous suspending liquors containing dissolved impurities to remove such impurities by exchanging aqueous suspending liquid substantially free from such impurities for the aqueous suspending liquor comprises washing fibrous material of the suspension is aqueous suspending liquid substantially free from dissolved impurities; and forming a washed fibrous suspension in such liquid; withdrawing aqueous suspending liquor containing dissolved impurities; diluting the washed fibrous suspension by adding aqueous suspending liquid substantially free from dissolved impurities; measuring the volume amount of such diluting aqueous suspending liquid added; measuring the volume amount of diluted washed fibrous suspension; and then adjusting the volume amount of wash liquid added to maintain substantially constant the difference between the amount of wash liquid added and the liquid content of the undiluted washed fibrous suspension.

The process of the invention is applicable to any kind of aqueous fibrous cellulose pulp suspension, including chemical pulps, mechanical pulps, chemimechanical pulps, semichemical pulps, and thermomechanical pulps, for example, sulfite pulps, sulfate pulps, and pulps obtained from the oxygen/alkali pulping of lignocellulose material.

In the drawings:

FIG. 1 is a graph showing the washing loss in kg $Na_2SO_4$ per ton of sulfate pulp, according to dilution, in tons of liquid per ton of sulfate pulp; and FIG. 2 is a flow sheet showing a cellulose pulp washing system for a pulp mill capable of producing chemical pulp, such as Kraft or sulphate pulp, utilizing wash filters in two stages.

The pulp washing system of FIG. 2 receives the cellulose pulp directly from the digester, suspended in spent or original black liquor, via line 1, collecting it into a storage or equalizing reservoir 2, provided with a stirrer 3 to maintain the pulp suspension uniform. A line 3*a* at the bottom of the reservoir is in flow connection with the filtration tank 4, receiving washing liquor from the first washing stage, led from the interior of the cylindrical filter drum 6 via line 4*a*. The liquor in the tank 4 contains the main proportion of the dissolved solids entering via line 1 in the black liquor suspending the cellulose pulp fibers. Liquor entering via the line 3*a* is used to dilute the pulp in reservoir 2, and is pumped from the tank 4 by the pump P1 for the purpose. The diluted pulp suspension, thoroughly mixed by the stirrer 3, then is led by the line 3*b* to the inlet box 5 for the first washing stage. The box 5 is in flow communication via line 5*a* with line 3*a* and the tank 4, and the pulp suspension can therefore be further diluted with the liquor from the tank 4 while in the inlet box 5.

In normal operation, the cellulose pulp suspension in black liquor entering the reservoir 2 has a pulp concentration of approximately 12%. After dilution in two stages, first in the reservoir 2 and then in the inlet box 5, the pulp concentraton is reduced to approximately 1%.

The diluted pulp is led from the inlet box 5 by overflow into the dipping trough 6*a* of the first washing stage W1. The wash filter 6, a cylindrical filter drum of fine wire mesh, is rotated continuously clockwise while partially immersed in the dipping trough 6*a*. Suction is drawn on the interior of the cylinder by conventional means (not shown) so that the liquor is drawn through the wire mesh of the cylinder 6, and the pulp fibers are drawn down onto the surface of the wire mesh, forming a pulp web 6*b* thereon. The filtrate (washing liquor containing dissolved black liquor solids) is withdrawn from the interior of the cylinder via the line 4*a*, and stored in the tank 4.

The drum 6, rotating clockwise, carries the web of pulp fibers up to and beneath the spray nozzles 7, where a plurality of spray nozzles spray washing liquor onto the pulp layer or web. The liquor from these nozzles is obtained via line 8*b* from the tank 8, whence it is pumped to the nozzles by pump P2, and is the washing liquor from the second washing stage 12. This washing liquor has been utilized in washing stage 12, and is capable of washing out black liquor solids from the pulp web 6*b* on cylinder 6. This liquor also is drawn through the wire mesh by the suction, and is carried via line 4*a* into the tank 4.

The washed pulp web 6*b* on the drum is scraped off the wire mesh by the doctor blade 9*b*, at the entry to the outlet box 9, and the separated pulp is collected in the outlet box, in aggregates or clumps of fibers of varying sizes. The outlet box includes a screw 10 for blending these particles with dilution liquor.

The solids content of the pulp at this stage is from 12 to 18%, and dilution is required for transport to the next washing stage. Outlet box 9 is in communication via line 8*a* and pump P3 with the filtrate tank 8, and liquor from the tank 8 is pumped up to dilute the pulp in the box 9, so that a pulp suspension is formed at a pulp concentration of approximately 1%.

This diluted pulp suspension is then passed directly via line 9*a* to the inlet box 11 of the second washing stage W2, where the pulp overflows into trough 12*a*, and is taken up on the cylindrical wire mesh drum 12, exactly as in the first washing stage W1, by application of suction to the interior of the drum. The filtrate drawn through the mesh is brought to the tank 8 via line 8*c*, while a web 12*b* of pulp fibers is formed on the surface of the drum.

This drum 12 also rotates clockwise, and the pulp web is carried upwardly by the clockwise rotation of the drum to beneath the array of nozzles 14, which spray washing liquid thereon, conveyed thereto via line 13. This liquid is normally pure water, or a steam condensate obtained at an evaporation stage in the pulp mill, for example, condensation of steam from the evaporators in the black liquor recovery system. The wash water from the nozzles 14 is drawn through the pulp web 12*b* into the interior of the drum 12, and then carried via line 8*c* to tank 8.

The pulp web 12*b* is removed from the drum by the doctor blade 16*a*, and the aggregates or clumps of fibers of varying size collected in the outlet box 16. The solids content of the pulp is from 10 to 15% at this stage.

Each of the filtrate tanks 4, 8 is provided with liquid level sensors 17, 18, the sensor 17 controlling valve 19 in the washing liquor discharge line 32, via control line 17*a*, and the sensor 18 controling valve 20 in line 8*b* leading to the spray nozzles 7, via control line 18*a*. The recovered washing liquor, referred to as thin liquor, is passed via line 32 to an evaporation stage, for recovery of the dissolved solids.

The washing system employs the counterflow principle, in which the water from the last washing stage W2 is used in sequence up the series of washing stages to the first washing stage W1, and then discharged. While only two such stages are shown, one, two, three, four or more washing stages of the same type, in the same series interconnection, can of course be interposed between stages W1, W2, as is conventional.

The process in accordance with the invention is applied to this washing system following the washing stage, W2.

In order to supply the correct quantity of washing liquid through the line 13 and thereby correctly control the dilution factor, the liquid content of the pulp, which leaves the washing system when it is stripped from the filter 12 by the doctor blade 16*a*, must be determined.

This determination can be carried out in either of two ways depending upon whether it is known how much pulp enters the washing system at line 1.

If it is not known how much pulp enters the system, then the determination is carried out as follows:

Let it be assumed that this pulp has a solids content of 12%. The pulp in the outlet box 16 is then diluted with suspending liquor through lines 21,22 via valve 23. It has been found most suitable to dilute the pulp here to a concentration within the range from about 1 to about 10%, preferably from about 2 to about 5%. Although the dilution can be carried out in one step, it is suitably carried out in two steps, once in the outlet box 16 via lines 21, 22 and and valve 23, and again beyond the outlet box 16 via lines 21,25 and valve 26. In this case, the first dilution in the outlet box 16 is a rough dilution, without applying precise measurement or control, and can be effected by the operator using his own spot judgment, and manual control of the valve 23. After this rough dilution, the diluted pulp proceeds via line 24 past the junction with line 25. Here, more suspending liquid is combined with the pulp, but the amount of suspending liquid introduced through the line 25 is controlled by the valve 26. This valve is in turn controlled by a pulp concentration meter 27, in line 24, which automatically controls the amount of liquid added via line 25, to give the desired pulp concentration. The pulp concentration line 24 normally is approximately 3%.

The quantity of diluting liquor repaired to obtain the desired pulp concentration is measured continuously by the flowmeter 28 in line 21, which is for example of the magnetic type. The total flow of pump suspension departing from the system in line 24 is also measured continuously, by the flowmeter 29, which can be of the same type as the flowmeter 28.

It should here be noted that nothing of the liquid entering through the line 21 and used for dilution of the washed pulp, is entering the actual washing system. It does not affect the dilution factor of the washing system and is used only to dilute the already washed pulp.

Information concerning the amount or volume of flow in lines 21 and 24 can be collected by the signal converter 30, and this information together with the pulp concentration is used to continuously calculate the liquid content of the washed pulp entering in the outlet box 16, i.e. after the pulp leaves the last wash filter 12.

With the aid of the signal converter 30, the quantity of washing liquor supplied through the line 13 is then regulated via control valve 31, so as to obtain constant dilution factor of the washing system.

If the amount of cellulose pulp (calculated as absolutely dry pulp) flowing through the washing system is known, for example, by measuring the amount of pulp entering via line 1 into the reservoir 2, there is no need to measure the pulp concentration at outlet box 16 and the measuring device 27 then can be omitted. There is then a direct relationship between pulp concentration and the total flow of suspension in line 24. With a constant flow of pulp, calculated as absolutely dry pulp, the amount of dilution liquid flowing through the line 21 can be controlled directly according to the total flow of suspension in line 24, so as to maintain a constant suspension flow. In this alternative approach, the flows in lines 21 and 24 are continuously measured by the flowmeters 28 and 29, as before.

By indirectly measuring the quantity of liquid contained in the washed pulp leaving the wash system when it is stripped from the filter 12 by the doctor blade 16*a*, the supply of washing liquor through the line 13 can be so regulated that dilution factor calculated as earlier mentioned, can be maintained constant, and independent of variations in pulp concentrations from the last washing stage, foaming and rewetting of the pulp.

The quantity of liquid accompanying the washed pulp from the washing process can be calculated as follows:

Let:

$Q$ = the total volume flow per unit of time.

$Q_{24}$ = the total volume of suspension flow per unit of time in the line 24.

$V$ = the total liquid volume flow per unit of time.

$V_{21}$ = the total liquid volume flow of diluent through line 21.

$V_{24}$ = the total liquid volume flow per unit of time through line 24.

$V_{pulp}$ = the liquid content of the pulp when the pulp leaves the the washing stage.

$m$ = the concentration of the pulp suspension in the line 24.

Then:

The pulp concentration measuring device 27 controls the flow of diluent $V_{21}$ so that the concentration of the pulp suspension in line 24 has the specific value m. The value of m is known from the pulp concentration meter 27, and is normally 3%, but it can vary from 1 to 10%, as indicated previously. By measuring the suspension flow $Q_{24}$, the flow of cellulose fibers calculated as absolutely dry pulp can be calculated as $m \times Q_{24}$. The liquid volume flow in line 24 $V_{24}$ is then equal to:

$$V_{24} = Q_{24} - m \times Q_{24} = (1 - m) Q_{24}$$

When a liquid balance is established, the following relationship is obtained:

$$V_{pulp}+V_{21}=V_{24}$$

$$V_{pulp}=V_{24}-V_{21}$$

$$V_{pulp}=(1-m)Q_{24}-V_{21}$$

where m is known from the pulp concentration meter 27

$Q_{24}$ is measured in flowmeter 29.

$V_{21}$ is measured in the flowmeter 28.

Thus, $V_{pulp}$ can be calculated and followed continuously.

As previously mentioned, the flow of cellulose fibers $=m\times Q_{24}$.

In this way, information is obtained as to the quantity of liquid per quantity of cellulose fiber leaving the washing system with the washed pulp. The amount of washing liquor supplied $V_{13}$ can then be controlled so that the difference $V_{13}-V_{pulp}$ is maintained constant in relation to the quantity of cellulose fibers.

When the production of cellulose pulp is known, for example by means of a measurement upstream of the washing system, it is not necessary to measure the concentration of the pulp, as previously mentioned, and consequently no meter 27 need be provided.

The amount of liquid accompanying the pulp from the washing filter 12 can be calculated in the following manner.

$V_{21}$ and $Q_{24}$ are measured $V_{24}=Q_{24}-$pulp production

The pulp production is expressed as unit volume/unit time, as previously shown:

$$V_{pulp}=V_{24}-V_{21}, \text{ i.e.}$$

$$V_{pulp}=(Q_{24}-\text{pulp production})-V_{21}$$

The amount of washing liquor supplied through line 13 is then controlled on the basis of this value, so that constant dilution is obtained.

The following Examples in the opinion of the inventors represent preferred embodiments of the invention.

EXAMPLE 1

The process of the invention and a control utilizing a conventional control system were applied in a washing system similar to that shown in FIG. 2, but utilizing four wash filters of the type shown, in series. The system was then applied to the washing of birch Kraft pulp.

In the control run the pulp concentration meter 27 and the flowmeters 28,29 were nonoperational, and no controls were attempted there. The supply of washing liquor through line 13 was controlled manually in such a manner that the solids content of the recovered liquor at line 32 was held constant at approximately 15%. The levels in the filtrate tanks 4,8 etc. for each wash filter stage were held constant, so that no filtrate or washing liquor could accumulate there. Whenever an increase in the solids content in the recovered liquor, removed at line 32, was observed, the amount of washing liquid supplied at line 13 was increased, to return the solids content of the recovered liquor to the desired level. Similarly, a decrease in the solids content in the recovered washing liquor was compensated for by a reduction in the supply of washing liquid through line 13.

Examples of the washed pulp obtained at the last washing stages were taken over a predetermined test period. During this test period, the pulp concentration was found to vary between 10 and 15% by weight. The flow of water was measured, and from these results, the variation in the dilution factor of the washing system calculated to be between 1 and 6 cubic meters per ton of pulp, the mean dilution over the test period being 3 cubic meters per ton of pulp. During the test period, the washing losses varied between 50 and 100 kilograms of solids per ton of pulp; calculated as alkali; 25 to 50 kilograms of sodium sulfate per ton of pulp. The average value of the washing losses was 80 kilograms of solids and 40 kilograms of sodium sulfate, per ton of pulp.

The washing system was now modified in accordance with the invention by adding the pulp concentration meter 27 and flowmeters 28,29 in the lines 21, 24, and the pulp concentration meter 27 was used to control the dilution of the washed pulp to a 3% concentration. Using the flowmeters 28,29, it was then possible to calculate the amount of washing liquor for a predetermined degree of dilution factor at any given stage of the washing. In this way, the dilution factor was controlled to $3m_3$ per ton of pulp.

As a result, the washing losses fell markedly to 20 to 40 kilograms of solids, and 10 to 20 kilograms of sodium sulfate, per ton of pulp, respectively. These washing losses were approximately half the washing losses obtained in the control run, without there being any increase in the quantity of washing liquor employed.

The solids content in the four liquor tanks in each washing stage was held substantially constant throughout the test period.

EXAMPLE 2

The same washing systems were used as described in Example 1. The system was the same as that shown in FIG. 2, with four washing stages, but the pulp concentration meter was omitted. In the control run, the flowmeters were nonoperational, while in the run according to the invention, the flowmeters were used, as indicated in Example 1. The flowmeters 28,29 were used mounted in the diluent line 21, and in the line 24 for the washed and diluted pulp suspension. Since the flows of the washed and diluted pulp suspension and of the diluent liquor were measured, it was possible to regulate the spray liquid flow to a given value, since the pulp production was known.

It is thus evident that it is possible using the process of the invention to reduce the washing losses to less than half of the losses experienced using the previous method, without the addition of more washing liquor.

While the invention has been illustrated in the drawings by wash filters in two or more stages, the invention can be applied to the washing of fibrous suspensions in any kind of apparatus used for the continuous washing of fibrous suspensions, and especially cellulose pulp, for example, pressure washing and continuous digester washing processes, as described in Rydholm, *Pulping Processes,* pages 722 to 733, inclusive, and in continuous diffuser washing, as in a Kamyr Continuous Diffuser. This type of continuous diffuser has an outer casing within which there are a number of concentric double-sided screen rings. Each screen ring is fastened to radial drainage arms with vertical lifting bars at the ends, which in turn are connected to hydraulic cylinders. The pulp enters in the bottom of the conical part of the casing and moves upwards.

The automatically regulated hydraulic cylinders are lifting the screen unit with approximately the same speed as the pulp suspension is moving upwards. At the end of the lift the extraction is momentarily shut off whereafter the screen unit makes a rapid downward movement, clearing the screen surface.

Above the screen unit rotates a set of scraper-arms, on which the nozzles for distribution of wash liquor are fastened.

The wash liquid displaces the liquor in the pulp, which in turn is extracted through the concave and the convex sides of the screen rings.

The displacement liquor, thus collected by the screens, is flowing down to the drainage arms and to a collecting pipe or header outside the shell.

The washed pulp is discharged at 10% with scraper plates erected on the rotating arms to a common outlet in the same manner as a conventional upflow bleaching tower.

Alternatively the washed pulp is diluted to 5% consistency. Dilution liquid is added through nozzles, which are erected on the distribution arms. Pulp and dilution liquid are mixed by the rotating arms. In this case the pulp level is kept constant above the rotating arms and the pulp outlet in order to avoid air entrainment in the pulp suspension to be discharged.

Having regard to the foregoing disclosure, the following is claimed as the inventive and patentable embodiments thereof:

1. A process for continuously washing fibrous suspensions having a varying consistency in aqueous suspending liquors containing dissolved impurities, dissolving said impurities by exchanging aqueous suspending liquid for the aqueous suspending liquor containing impurities, while controlling the dilution of the washed fibrous suspension that is obtained, which comprises in a continuous flow washing system having at least one washing stage washing fibrous material of the suspension with aqueous suspending liquid substantially free from dissolved impurities; and forming a washed fibrous suspension in said aqueous suspending liquid substantially free from dissolved impurities; separating from the washed fibrous suspension and withdrawing and recirculating back to a washing stage aqueous suspending washing liquid containing dissolved impurities washed out from the fibrous suspension; diluting the washed fibrous suspension from the washing stage by adding aqueous suspending liquid substantially free from dissolved impurities to the washed fibrous suspension; measuring (1) the volume amount of diluting aqueous suspending liquid added; and (2) the volume amount of diluted washed fibrous suspension; and then using these measured values to adjust continuously the volume amount of washing liquid added according to the consistency of the washed fibrous suspension, to maintain substantially constant any difference between the amount of washing liquid added and the liquid content of the undiluted washed fibrous suspension.

2. A process according to claim 1 in which the fibrous material is a cellulose pulp selected from the group consisting of chemical pulp, mechanical pulp, chemimechanical pulp, semichemical pulp, and thermomechanical pulp.

3. A process according to claim 2 in which the cellulose pulp is a chemical pulp selected from the group consisting of sulfite pulps, sulfate pulps, and pulps obtained from the oxygen-alkali pulping of lignocellulose material.

4. A process according to claim 1, which includes measuring the fiber concentration of the diluted washed suspension.

5. A process according to claim 4, in which the solids content of the fibrous suspension is maintained within the range from about 1 to about 10% by weight of the suspension.

6. A process according to claim 4, in which fiber concentration of the diluted washed suspension is measured and the amount of aqueous suspending liquid substantially free from dissolved impurities that is added is adjusted automatically according to fiber concentration to maintain fiber concentration substantially constant in the diluted washed suspension.

7. A process according to claim 4 in which the fibrous suspension is cellulose pulp.

8. Apparatus for continuously washing fibrous suspensions having a varying consistency in aqueous suspending liquors containing dissolved impurities dissolving said impurities by exchanging aqueous suspending liquid for the aqueous suspending liquor containing impurities while controlling the dilution of the washed fibrous suspension that is obtained, which comprises in a continuous flow washing system having at least one washing stage means for washing fibrous material of the suspension with aqueous suspending liquid substantially free from dissolved impurities; and forming a washed fibrous suspension in said aqueous suspending liquid substantially free from dissolved impurities; means for separating from the washed fibrous suspension and withdrawing and recirculating back to a washing stage aqueous suspending washing liquid containing dissolved impurities washed out from the fibrous suspension; means for diluting the washed fibrous suspension from the washing stage by adding aqueous suspending liquid substantially free from dissolved impurities to the washed fibrous suspension; means for measuring the volume amount of diluting aqueous suspending liquid added; means for measuring the volume amount of diluted washed fibrous suspension; and means for calculating continuously using these measured values to adjust the volume amount of washing liquid added according to the consistency of the washed fibrous suspension, to maintain substantially constant any difference between the amount of washing liquid added and the liquid content of the undiluted washed fibrous suspension.

9. Apparatus according to claim 8 comprising a fiber concentration meter for measuring fiber concentration in the diluted washed fibrous suspension; and means operatively associated with the meter for adjusting the amount of aqueous suspending liquid substantially free from dissolved impurities according to the fiber concentration measured by the meter.

* * * * *

UNITED STATES PATENT AND TRADEMARK OFFICE

CERTIFICATE OF CORRECTION

PATENT NO. : 4,273,612

DATED : June 16, 1981

INVENTOR(S) : Per Axel Rune Hillstrom et al

It is certified that error appears in the above—identified patent and that said Letters Patent is hereby corrected as shown below:

| | | |
|---|---|---|
| Column 3, line 44 | : | "dilutin" should be --dilution— |
| Column 3, line 65 | : | before "more" insert --may-- |
| Column 4, line 22 | : | "that" should be —the-- |
| Column 5, line 30 | : | "is" should be --in-- |
| Column 7, line 12 | : | "controling " should be --controlling-- |
| Column 7, line 26 | : | following "the" insert --last-- |
| Column 7, line 62 | : | "repaired" should be --required-- |
| Column 10, line 25 | : | "$3m_3$" should be --$3m^3$— |

Signed and Sealed this

*Twenty-third* Day of *April 1985*

[SEAL]

*Attest:*

DONALD J. QUIGG

*Attesting Officer* *Acting Commissioner of Patents and Trademarks*